US007226032B2

(12) United States Patent
Schlais et al.

(10) Patent No.: US 7,226,032 B2
(45) Date of Patent: Jun. 5, 2007

(54) PICTURE-HANGING DEVICE

(76) Inventors: Richard A. Schlais, 5808 Madison St., Morton Grove, IL (US) 60053; Donald E. Truitt, 5808 Madison St., Morton Grove, IL (US) 60053

( * ) Notice: Subject to any disclaimer, the term of this patent is extended or adjusted under 35 U.S.C. 154(b) by 12 days.

(21) Appl. No.: 11/194,188

(22) Filed: Aug. 1, 2005

(65) Prior Publication Data

US 2007/0023605 A1 Feb. 1, 2007

(51) Int. Cl.
*F16M 13/00* (2006.01)

(52) U.S. Cl. ..... 248/547; 248/466; 33/644; 33/645; 33/666

(58) Field of Classification Search ..... 33/613, 33/644, 645, 666, 614; 248/547, 466; 81/489
See application file for complete search history.

(56) References Cited

U.S. PATENT DOCUMENTS 4,455,756 A * 6/1984 Greene ..... 33/613
D317,575 S * 6/1991 Ramsey ..... D10/71
5,180,135 A * 1/1993 Hindall ..... 248/544
5,471,760 A * 12/1995 Farris ..... 33/613
5,867,917 A 2/1999 Karon
6,032,378 A * 3/2000 Null ..... 33/613
6,049,991 A * 4/2000 Gruenberg et al. ..... 33/613
6,739,065 B2 * 5/2004 Hofmeister et al. ..... 33/613
6,782,633 B1 * 8/2004 Cedrone et al. ..... 33/613
6,971,184 B2 * 12/2005 Prevost ..... 33/613
D513,575 S * 1/2006 Carson et al. ..... D8/16

* cited by examiner

*Primary Examiner*—Amy J. Sterling
(74) *Attorney, Agent, or Firm*—Meroni & Meroni, P.C.; Charles F. Meroni, Jr.; Christopher J. Scott

(57) ABSTRACT

A picture-hanging device, method, and kit enable a user to effectively mark a select vertical location and quickly hang a picture at the select vertical location. The device comprises a hanger portion and a handle portion. The hanger portion comprises an anterior surface, an elongate hanger slot, and a hanger hook, all of which depend from the handle portion. The hanger slot extends through the hanger portion adjacent the end of the hanger portion. The hanger hook extends from the anterior surface and is designed to receive and support a picture-hanging cord and its load. The anterior surface comprises certain indicia for marking the select vertical location of a superior picture portion. Together with the hanger slot, the indicia enable the user to mark the select vertical location, after which the user may hang the picture at the select vertical location upon a fixed picture anchor.

17 Claims, 5 Drawing Sheets

PICTURE-HANGING DEVICE

BACKGROUND OF THE INVENTION

1. Field of the Invention

The present invention generally relates to a hand tool for enabling a user to more effectively hang a picture or similar other article having an article-hanging cord or wire. More particularly, the present invention relates to picture-hanging device for enabling a user to quickly and easily hang a picture at a select vertical location, the device essentially easing the process of locating the preferred location for a picture support anchor.

2. Description of the Prior Art

A number devices for aiding users in locating picture-hanging anchors are known in the prior art. For example, U.S. Pat. No. 5,867,917 ('917 Patent), which issued to Karon, discloses a Picture Hanger Locating Device. The '917 Patent teaches a picture hanger locating device for use with a picture having a hanging cord positioned on the rear thereof intended to be disposed over a hook or like member to be secured to a wall behind the desired location of the picture. A cord tensioning member is adapted to be removably positioned at a first end thereof over the upper peripheral edge of the picture and at a second end spaced from said first end in communication with the cord to move the same to the tensioned position the cord will assume when the cord is disposed over the hook member. A wall marking device is secured to the second end facing away from the rear of the picture and toward the wall to mark the wall at the location along the length of the cord where the hook member should be placed to engage the cord when the picture is hung on the wall.

It will be seen from a review of the above-referenced patent and other prior art generally known to exist that the prior art does not teach a manually graspable, picture-hanging device outfitted with certain indicia means for locating a select vertical location to hang a picture, which device further comprises anchor marking means for locating a picture anchor according to the positioning of a picture-hanging cord. The prior art thus perceives a need for manually graspable, picture-hanging device outfitted with certain indicia means for locating a select vertical location to hang a picture, which device further comprises anchor marking means for locating a picture anchor according to the positioning of the picture-hanging cord cooperatively associated with the picture.

SUMMARY OF THE INVENTION

Accordingly, it is an object of the present invention to provide a low cost picture-hanging device for easing the amount of work involved in hanging pictures and similar other articles. To achieve this and other readily apparent objectives, the present invention provides a picture-hanging device for enabling a user to find and accurately position a hanging device for hanging pictures and other devices or decorations on a wall. It is noted that it is often difficult or awkward to accurately locate the spot on the wall to place a hanging device when the exact spot is not visible or known. The picture-hanging device of the present invention has been developed to solve the noted problem. The position for the hanging device or anchor can be quickly and easily determined by creating a temporary, substitute hanging device marked with certain indicia for positioning the superior portion of a picture relative to the apex of the picture-hanging cord when in a taught state (as hang upon a temporary hook-like structure). Thus, the present invention may be utilized to determine the desired position of the object to be hung. Notably, this invention can be utilized alone and/or with other tools.

The object to be hung on the wall (the picture) is temporarily hung on the "hook" at the bottom of the temporary, substitute hanger device. This "stretches" the wire to its full extension and/or locates the apex of the picture wire when hung. The desired picture location is then determined on the wall using the handle and any other useful items or outside help. Once the desired position on the wall has been determined, a mark will be made on the wall to coincide with a mark on the temporary substitute hanger. The picture is then removed from the substitute hanger and the substitute hanger is rematched or realigned with the mark on the wall. Behind the "hook" is the place for the permanent hanging device to be affixed to the wall. Any number of permanent hanging devices can be utilized. More than one temporary substitute hanger may be needed or utilized for larger items to be hung on a wall. The present invention, as summarized, quickly and easily allows someone to locate and place a picture hanging device on a wall so that the picture hangs in the desired position. The picture-hanging device could be a nail, "J" hook, or gummed label with hook or many other things.

Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief description of my patent drawings, as follows.

DETAILED DESCRIPTION OF THE PREFERRED EMBODIMENT

Figure 1:
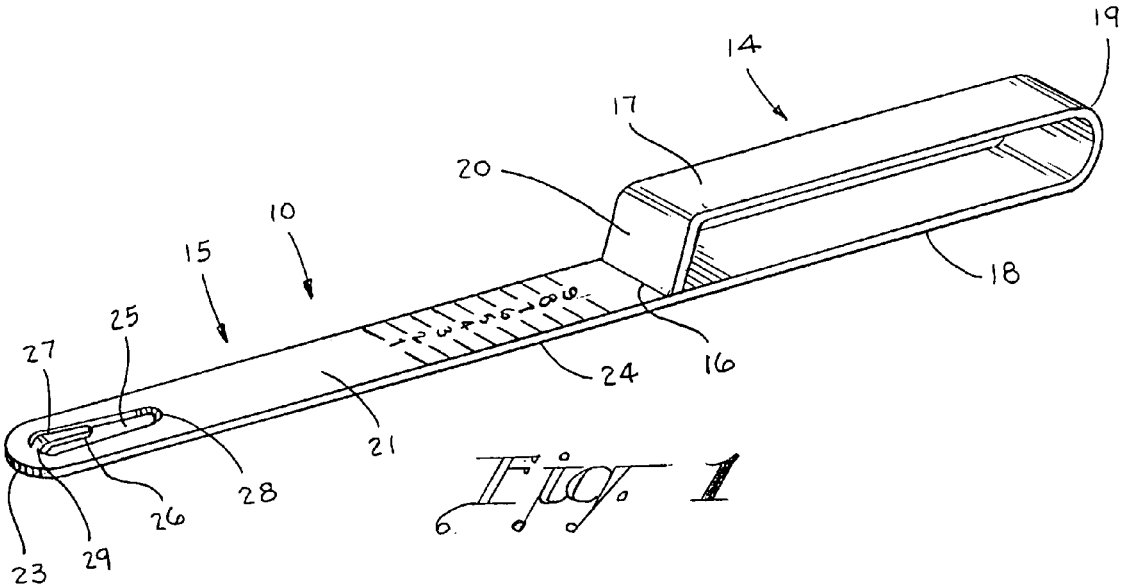
FIG. 1 top perspective view of a preferred embodiment of the picture-hanging device of the present invention.
Figure 2:
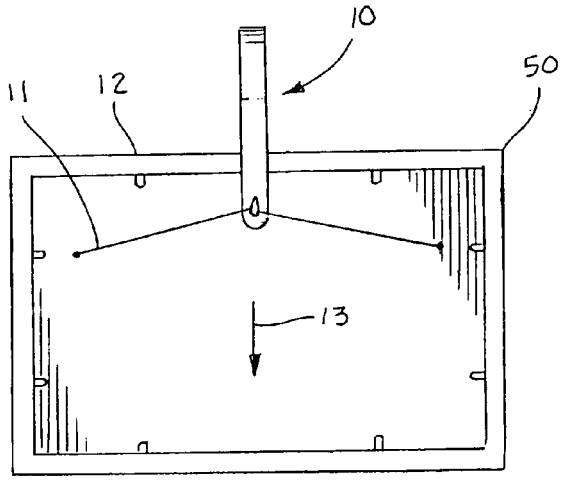
FIG. 2 is a rear plan view of the picture-hanging device as used to hang a picture outfitted with a picture-hanging cord.
Figure 3:
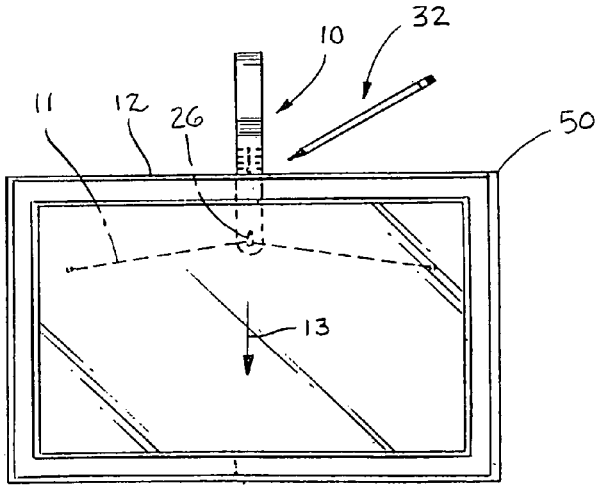
FIG. 3 is a front plan view of the picture-hanging device as used to hang a picture outfitted with a picture-hanging cord, the inferior portion of the picture-hanging device and the picture-hanging cord being shown in broken lines.
Figure 4:
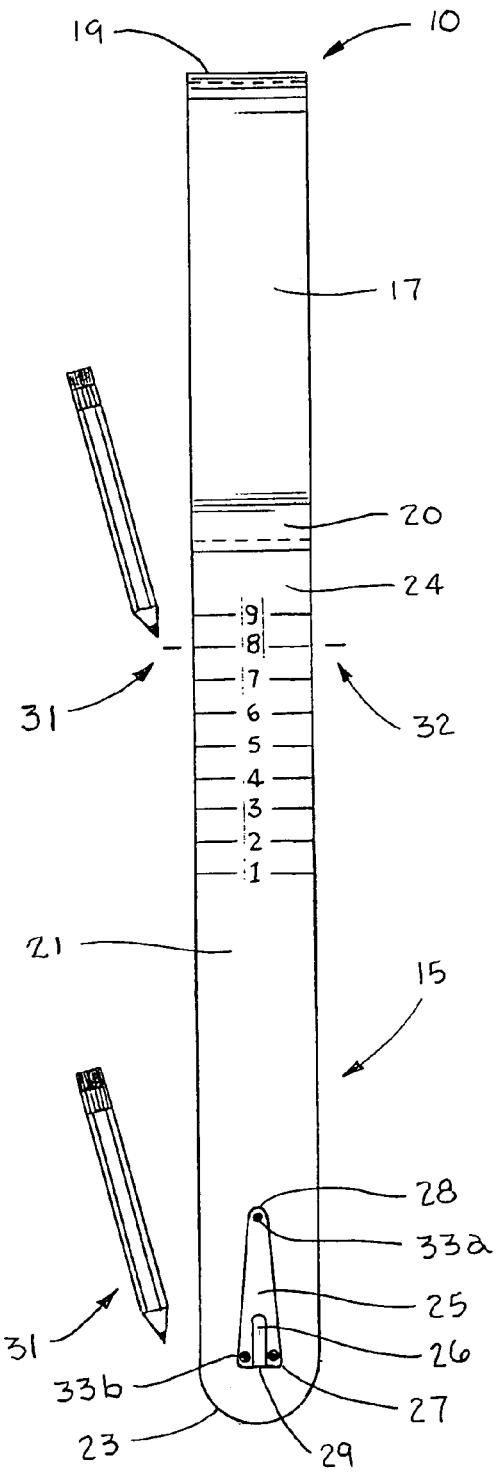
FIG. 4 is a front plan view of the picture-hanging device as shown with exemplary marking implements for marking a select vertical location.
Figure 5:
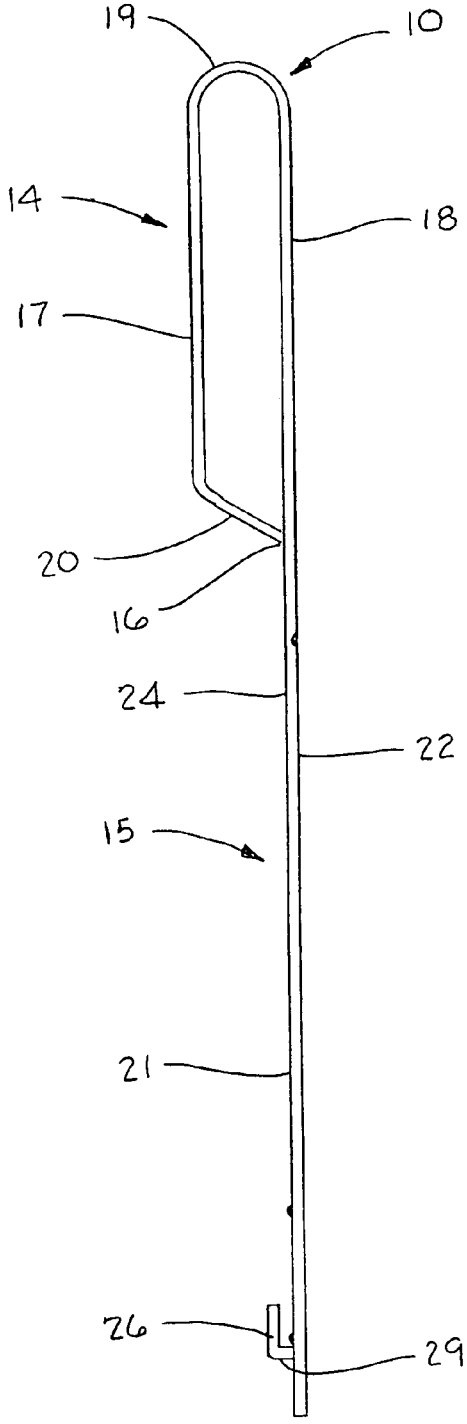
FIG. 5 is a profile or side plan view of the picture-hanging device showing a looped handle portion, a planar hanger portion, and a hanger hook.
Figure 6:
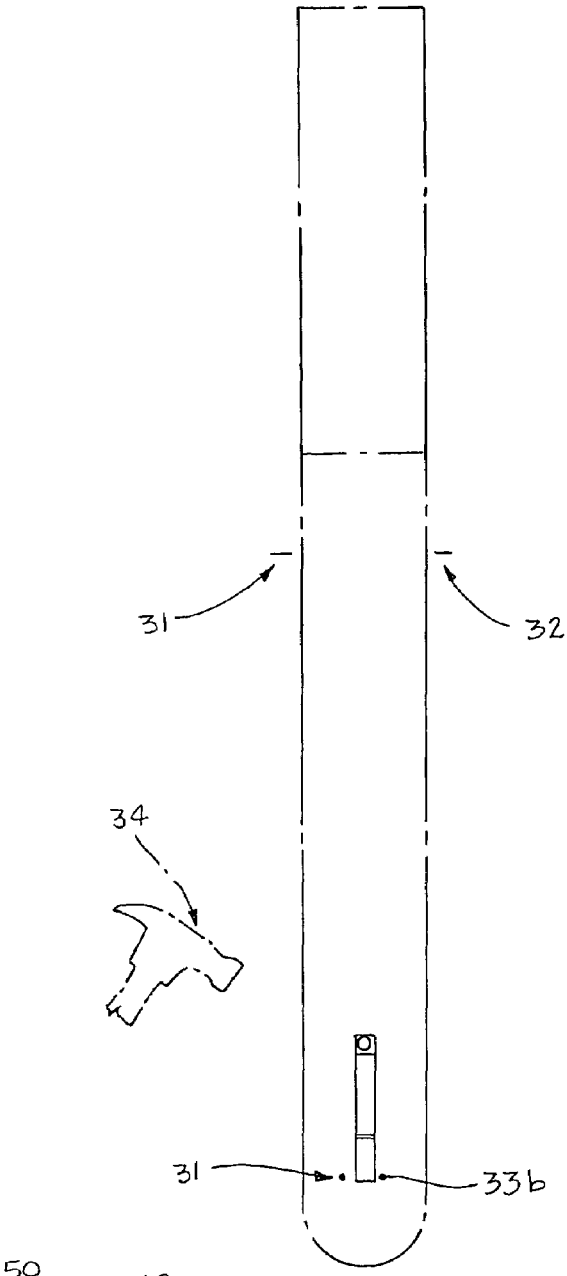
FIG. 6 is a front plan view of a picture anchor as attached to a wall, having been attached to the wall by a hammer (as shown in fragmentary broken lines), and as positioned by the picture-hanging device (as shown in broken lines) in superior adjacency to a superior picture portion (as shown in broken lines).
Figure 6:
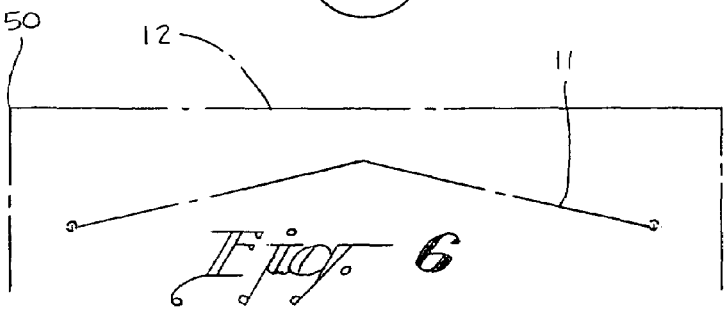
Figure 7:
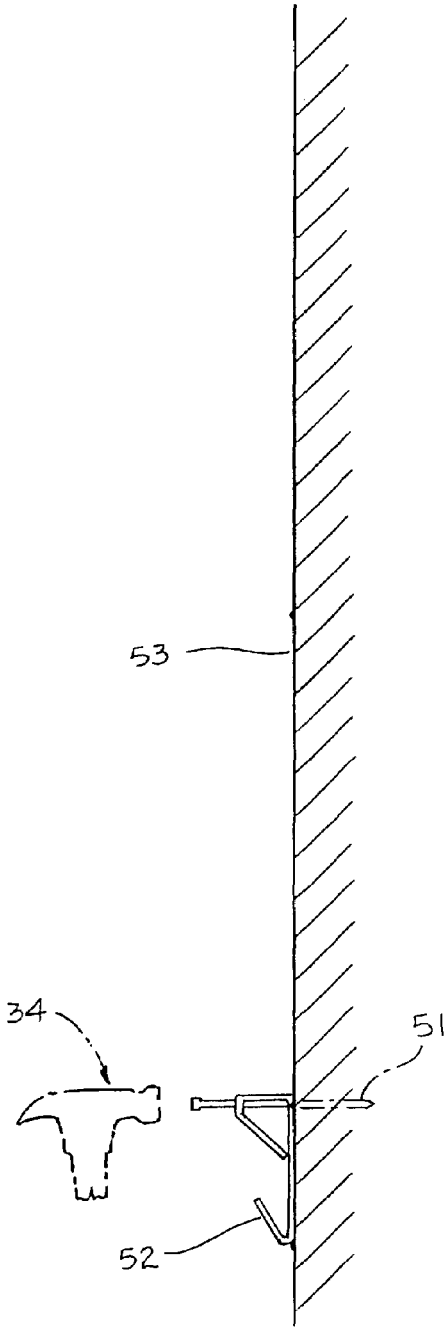
FIG. 7 is a fragmentary cross-sectional side view of a picture display wall showing a picture anchor assembly being mounted to the wall by a hammer (as shown in fragmentary broken lines) at a select vertical locations as enabled by the picture-hanging device.
Figure 8:
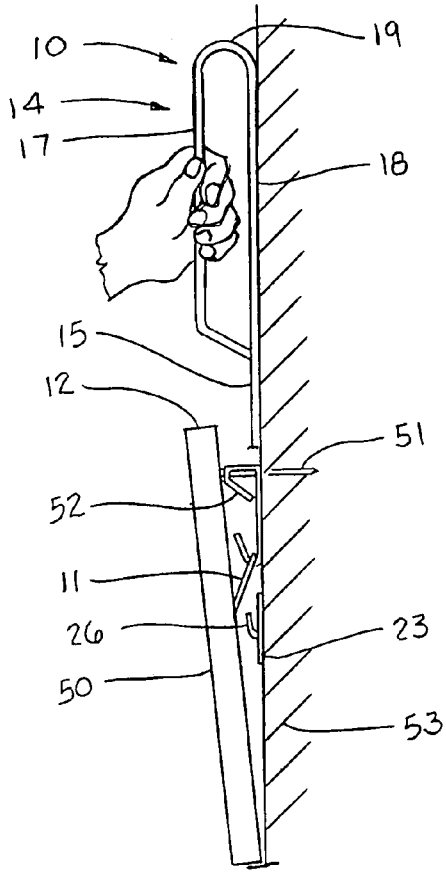
FIG. 8 is a fragmentary cross-sectional side view of the picture display wall shown in FIG. 7 depicting a user's hand lowering a picture onto the mounted picture anchor assembly via the picture-hanging device, the hanger portion of the picture-hanging device being shown with parts broken away to clearly show the picture anchor assembly.
Figure 9:
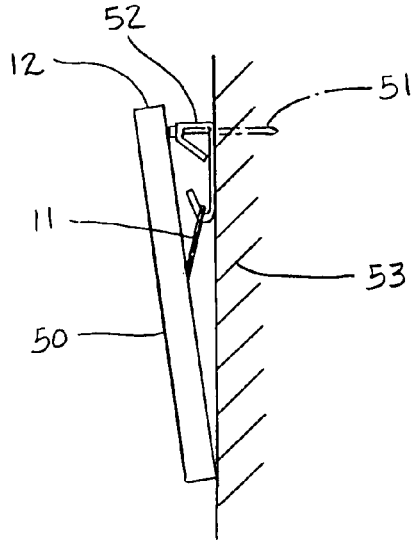
FIG. 9 is a fragmentary cross-sectional side view of the picture display wall shown in FIG. 8 depicting the picture being hung upon the picture anchor assembly.
Figure 10:
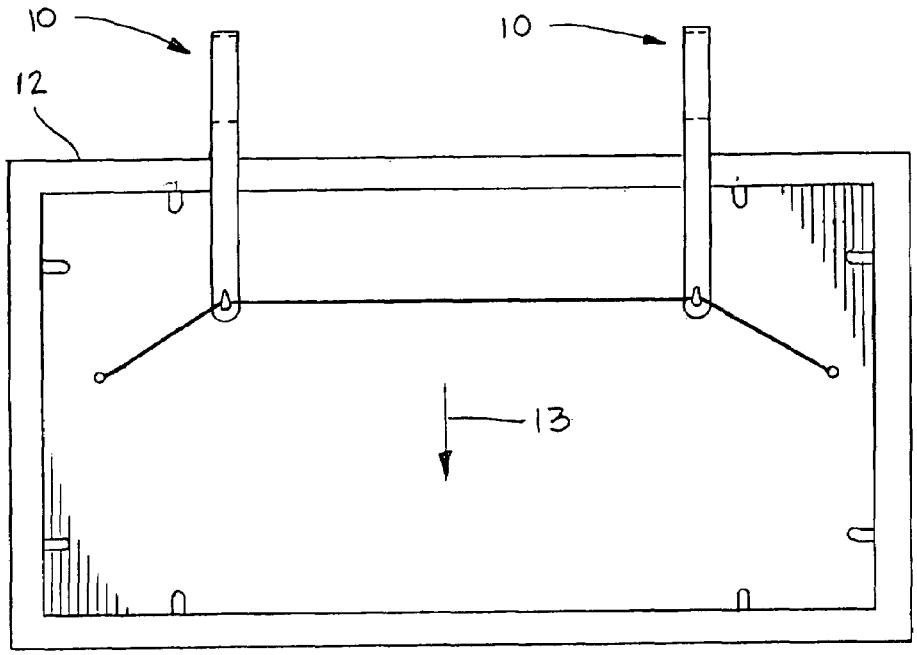
FIG. 10 is a rear plan view of laterally-spaced, uniformly vertical picture-hanging devices as used to hang a picture of relative wider/larger magnitude, which picture is outfitted with a picture-hanging cord.
Figure 11:
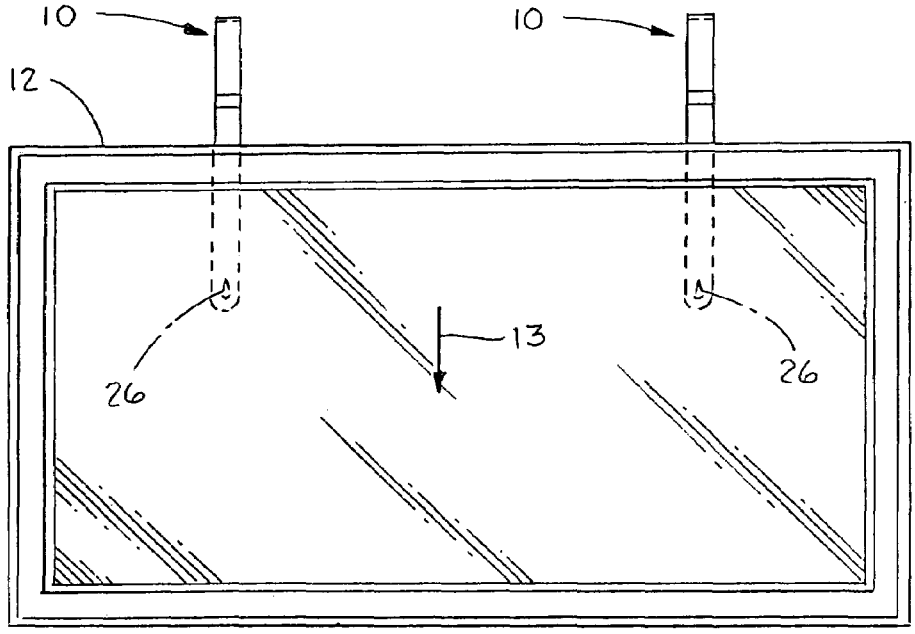
FIG. 11 is a front plan view of the picture-hanging devices shown in FIG. 10 as used to hang the picture shown in FIG. 10, the inferior portions of the picture-hanging devices being shown in broken lines.

Referring now to the drawings, the preferred embodiment of the present invention concerns a picture-hanging device 10 as generally illustrated and referenced in FIG. Nos. 1–5, 8, 10, and 11. It is contemplated that picture-hanging device 10 functions to enable the user to find and accurately position a hanging device(s) for hanging pictures and other devices or decorations on a wall. A generic picture 50 has been illustrated and referenced in FIG. Nos. 2, 3, 6, 8, and 9. It will be understood that the problem being addressed is to accurately locate the spot on the wall to place a hanging device when the exact spot is not visible or otherwise known. Picture-hanging device 10 has been developed to solve the noted problem. The position for the hanging device or anchor can be quickly and easily determined by creating a temporary substitute hanging device for use while determining the desired position of the object to be hung. These functions are achieved with picture-hanging device 10. Notably, picture-hanging device 10 may be utilized alone and/or in combination with other tools, such as hammers, anchors, and/or marking means.

In other words, picture-hanging device 10 enables a user to mark a select vertical location on a wall or other area having vertical dimensions for quickly and effectively hanging a picture 50 or similar other article, such as a mirror, painting, tapestry, banner, and the like. In this regard, it has been noted that article or picture-hanging of the type noted often requires awkward pre-positioning of pictures or articles and certain guesswork as to how far the article- or picture-hanging cord or wire will displaced from a relaxed, unengaged state to an article- or picture-hanging state, and further how far the pinnacle of the picture-hanging wire or cord will be from the superior portion of the article so that an anchor or similar other picture-hanger may be precisely placed at the select vertical location in the wall or similar other display area.

It will thus be seen that picture-hanging device 10 functions to enable a user to mark a select vertical location and further to hang a picture at the select vertical location. Necessarily, the picture 50 or article to be hung essentially comprises a picture-hanging cord 11 as generally illustrated and referenced in FIG. Nos. 2, 3, 6, and 8–10; a picture load (for example, the weight of the picture or article) as generally referenced at vector 13 in FIG. Nos. 2, 3, 10, and 11; and a superior picture portion 12 as generally referenced in FIG. Nos. 2, 3, 6, and 8–11.

Picture-hanging device 10 is preferably constructed from a single piece of loopable, substantially planar, elongate material such as steel. It is contemplated that picture-hanging device 10 could be formed from injection molded plastic(s), however, excellent results have been obtained when device 10 is formed from steel or similar other metal. In this last regard, it is contemplated that the preferred uniform thickness of the metal or steel is 1/16 of an inch (0.0625 inches). Thus, it will be understood that picture-hanging device 10 is preferably formed from a substantially planar, elongate material having a substantially uniform material thickness, the material thickness measuring about 0.0625 inches.

Picture-hanging device 10 comprises a looped handle portion 14 as most clearly illustrated and referenced in FIG. Nos. 1, 5, and 8; a substantially planar hanger portion 15 as illustrated and referenced in FIG. Nos. 1, 4, 5, and 8; a handle-hanger junction 16 as generally referenced in FIG. Nos. 1 and 5; a substantially uniform handle width, preferably on the order of 1 inch; a handle length preferably on the order of 5 inches; and a loop thickness measures about 0.7 inches (0.707 inches). Handle portion 14 preferably comprises a substantially planar anterior portion 17 as referenced in FIG. Nos. 1, 4, 5, and 8; a substantially planar posterior portion 18 as referenced in FIG. Nos. 1, 5, and 8; a semi-cylindrically-shelled handle terminal region 19 as referenced in FIG. Nos. 1, 4, 5, and 8; and a substantially planar handle junction region 20 (an extension portion of anterior portion 17) as referenced in FIG. Nos. 1, 4, and 5. It will be seen from an inspection of the noted figures that handle terminal region 19 joins anterior portion 17 to posterior portion 18 opposite handle-hanger junction 16 and junction region 20 angularly attaches anterior portion 17 to posterior portion 18 at handle-hanger junction 16. Preferably, anterior portion 17 is substantially parallel to posterior portion 18 and in this regard, it will be understood that handle portion 14 preferably has a substantially uniform loop thickness.

Anterior portion 17 inherently has an anterior length, preferably measuring about 4 inches. The handle junction region 20 inherently has a handle junction length, preferably measuring about 1 inch. The handle junction region 20 is preferably angled from the anterior portion at a 135 degree angle and thus posterior portion inherently has a posterior length measuring about 4.7 inches (a 45 degree angle being between posterior portion 18 and handle junction region 20, and handle junction region 20 being on the order of 1 inch). Handle terminal region 19, is preferably a semi-cylindrically-shaped shell having a radius on the order of 1/3 of an inch (0.3535 inches). Thus the handle length is on the order of 5 inches (5.1 inches=4 inches+0.707 inches+0.3535 inches). Notably the loop thickness measures about 0.7 inches to receive a user's fingers 54 as generally depicted in FIG. No. 8. A user's set of fingers typically measures less than 0.7 inches and thus the finger-receiving loop thickness of about 0.7 inches allows for the user to comfortably insert his or her fingers through the looped handle portion 14 for manipulating picture-hanging device 10. It will thus be understood that anterior portion 17 has an anterior length, the difference between the handle length and the anterior length being substantially equal to the loop thickness and the diameter of handle terminal region 19. Handle terminal region 19 is preferably rounded for preventing snagged movement thereof as will be described in more detail below.

Hanger portion 15 preferably comprises an anterior surface 21 as referenced in FIG. Nos. 1, 4, and 5; a posterior surface 22 as referenced in FIG. No. 5; a semi-circular hanger terminal region 23 as referenced in FIG. Nos. 1, 4, 5, and 8; a hanger junction region 24 as referenced in FIG. Nos. 1, 4, and 5; an elongate hanger slot 25 as illustrated and referenced in FIG. Nos. 1 and 4; a hanger hook 26 as illustrated and referenced in FIG. Nos. 1, 3, 4, 5, 8, and 11. It will be noted from an inspection of the noted figures that the diameter of semi-circular hanger terminal region 23 is substantially equal to the hanger width, preferably on the order of 1 inch (substantially equal in magnitude to the handle width). The hanger portion 15 inherently has a hanger length, preferably on the order of 7 inches. Hanger slot 25 inherently has a slot length, preferably on the order of 2 inches. Hanger terminal region 23 is preferably rounded for preventing snagged movement thereof as will be described in more detail below.

Hanger slot 25, being elongate, preferably has a hook end 27 and an open end 28 and extends from anterior surface 21 to posterior surface 22 intermediate the hanger width, preferably centered along the longitudinal axis of hanger portion 15. Hook end 27 and open end 28 are referenced in FIG. Nos. 1 and 4. As will be understood from an inspection of the noted figures, hook end 27 is preferably situated adjacent hanger terminal region 23 and open end 28 is preferably situated longitudinally adjacent hanger junction region 24. Hanger hook 26 extends outwardly from anterior surface 21 toward the hanger junction region 24 intermediate hanger terminal region 23 and hook end 27 at a hook junction 29 as referenced in FIG. Nos. 1, 4, and 5. Hanger hook 26 is preferably sized and shaped to receive picture-hanging cord 11 or wire (which inherently has a certain transverse cross-sectional diameter or area). Hook junction 29 is preferably formed to support the picture load 13. In this regard, it will be noted that hanger hook 26 is integrally formed with hanger portion 15 and thus the matter comprising hanger portion 15 also comprises hanger hook 26 such that the chemical composition thereof is substantially uniform throughout and thus the materials used in the construction of picture-hanging device 10 should preferably comprise sufficient tensile-compressive strength properties to support picture load 13.

Further, hanger junction region is preferably attached to (integral with) handle portion 14 at handle-hanger junction 16, and thus, hanger portion 15 is preferably coplanar with posterior portion 18. Hanger junction region 15 preferably comprises select indicia means for enabling the user to mark the select vertical location, the select indicia means being selected based upon the location of the preferred location of superior picture portion 12. The select indicia means may preferably be defined by a series (or plurality) of equally-spaced, sequentially numbered parallel linear markings 30 extending across the hanger width perpendicular to the longitudinal axis of hanger portion 15 upon anterior surface 21. Linear markings 30 and hanger slot 25 together cooperatively function to enable the user to mark the select vertical location as generally depicted at 31 in FIG. Nos. 4 and 6. It will be seen from an inspection of FIG. Nos. 4 and 6 that the select vertical location is cooperatively marked in at least two vertical locations. The first vertical location is marked adjacent linear markings 30 as referenced at 32 (also generally depicted in FIG. Nos. 3 and 6) and the second vertical location is marked adjacent hanger terminal region 23 through hanger slot 25 as referenced at 33(*a*) in FIG. No. 4 and 33(*b*) as referenced in FIG. Nos. 4 and 6. It is contemplated that the equally-spaced, sequential numbering of linear markings 30 enable the user to more effectively mark the select vertical location and further to hang picture 50 at the select vertical location.

It should be noted, in this last regard, that different types of picture-hanging anchors function to support pictures and the like. For example, "J" hooks and straight nails, together cooperating as a picture anchor assembly, may both be utilized to hang picture 50. It will be seen from an inspection of FIG. No. 7 that both a straight nail 51 or similar other anchor may function to attach a "J" hook 52 or similar other hardware to a wall 53. Nail 51, "J" hook 52, and wall 53 have been further illustrated and referenced in FIG. Nos. 8 and 9, the same being depicted as supporting picture 50 via picture-hanging cord 1l. Notably, "J" hook 52 may be omitted from the anchor role and nail 51 may alone function to support picture 50. It is with this notion in mind that markings 33(*a*) and 33(*b*) have been made in FIG. No. 4. Marking 33(*a*) represents that spot where nail 51 may be driven (as depicted at 34 in FIG. Nos. 6 and 7) for attaching "J" hook 52. It will be understood that the spatial location where picture-hanging cord 11 is received is typically vertically displaced (downward) from the spatial location where "J" hook support nail 51 is driven. Thus, marking 33(*a*) represents the spatial location where nail 51 should be driven if attaching "J" hook 52. Conversely, markings 33(*b*) represent the spatial location where nail 51 should be driven if nail 51 itself is to be used as a picture anchor. Thus, picture-hanging device 10 enables the user to mark 31 and hang picture 50 at the select vertical location as selected by the user.

Having thus described the device in detail, it becomes apparent that certain inventive methodology exists for hanging picture 50 or similar other article with picture-hanging device 10. In this regard, it is contemplated the present invention contemplates a method of hanging an article or picture 50 at a select vertical location, the article or picture comprising an article-hanging cord (such as picture-hanging cord 11), an article load (such as picture load 13), and a superior article portion (such as superior picture portion 12). The method essentially comprises the steps of providing at least one article-hanging device, the article-hanging device comprising a looped handle portion, a substantially planar hanger portion, and a handle-hanger junction, substantially as described hereinabove and as depicted in FIG. No. 1. The user may then hang the article or picture upon the article-hanging device, the article-hanging cord being received by hanger hook 26. The hook junction sufficiently supports the article load as previously specified. FIG. No. 2 generally depicts a back or rear view of picture 50 being hung upon the article-hanging device.

The user may then select a select vertical location to hang the article or picture 50. In this regard, it is contemplated that the article or picture to be hung will necessarily involve both vertical and horizontal coordinates relative to some frame of reference. In this regard, the present methodology contemplates a select coordinate step, the select coordinate step being selected from the step grouping consisting of selecting a horizontal location to hang the picture and selecting a vertical location to hang the picture. Notably, the select coordinate step is to be undertaken after hanging the picture upon the picture-hanging device and before marking the select vertical location. It should be noted that the present invention is primarily designed to assist users in hanging the article at a select vertical location (the preferred spatial location of picture anchors often being difficult to finalize), but may be moved to and fro from side to side to select a select horizontal location. Thus it is contemplated that the methodology will necessarily include an additional step of selecting a select horizontal location to hang the article or picture.

FIG. No. 3 generally depicts a frontal view of picture 50 as hung upon the article hanging device and the preferred or select vertical location being marked. Thus, it will be noted that the user may then mark the select vertical (and horizontal) location via select indicia means, the select indicia means being selected based upon the location of the superior picture portion as depicted in FIG. No. 3. After marking the select vertical location, the user may then remove the article or picture from the article-hanging device and re-align the select indicia means with the marked select vertical location. FIG. No. 4 depicts the article-hanging device with picture 50 removed and the select indicia means or linear markings (linear marking No. 8) being realigned with markings 32.

After re-aligning article-hanging device as described, the user may then mark at least one select anchor location (as generally depicted at 31 in FIG. No. 4) via hanger slot 25. Naturally, the user will remove the article-hanging device from the spatial location where the article is to be hung and then may fix at least one article or picture anchor at the marked select anchor location as generally depicted in FIG. Nos. 6 and 7 at 34. The fixed picture anchor (e.g. nail 51 and "J" hook 52, in combination, or nail 51) functions to support the article or picture load 13. Once the picture anchor is fixed, the user may then re-hang the article or picture 50 upon the article-hanging device (as generally depicted in FIG. No. 2).

The user may then lower the article-hanging cord (such as picture-hanging cord 11) onto the article or picture anchor via the article-hanging device as generally depicted in FIG. No. 8. It will be understood from a consideration of the descriptions here presented in tandem with FIG. No. 8 that the fixed picture anchor removes the picture-hanging cord from the hanger hook by the downward motion and picture 50 is thus hung at the select vertical location. It is to be noted that hanger terminal region and handle terminal region are preferably rounded so that when the user displaces picture-hanging device 10 vertically, objects adjacent the device do not otherwise snag the vertical displacement thereof.

For larger pictures of greater width and/or magnitude (as is generally depicted in FIG. Nos. 10 and 11), it may become necessary to mount or hang the same upon two article or picture anchors (e.g. to support the greater picture load). In this regard, it is contemplated that two picture-hanging devices 10 may be provided and two picture anchors may be fixed according the methods here presented. During the process, the two picture-hanging devices and the two picture anchors are laterally spaced and utilized to mark a uniform vertical location (at the select vertical location). With this type of methodology, it is contemplated that superior picture portion 12 becomes substantially leveled (automatically) after the step of lowering the picture-hanging cord 11 onto the laterally-spaced, fixed picture anchors. According to user preference, a final step in hanging a picture or similar other article is leveling the article, and thus the present methodology contemplates leveling the superior picture portion 12 after the step of lowering the picture-hanging cord 11 onto the picture anchor.

It will thus be understood that the object to be hung on the wall (i.e. the picture or similar other article) is temporarily hung on hanger hook 25 at the bottom of the temporary substitute hanger device. This "stretches" the picture-hanging cord or wire to its full extension and/or locates the apex of the picture wire when hung. The desired picture location is then determined on the wall by using the indicia means and/or the handle portion and any other useful items or outside help. Once the desired position on the wall has been determined, a mark will be made on the wall to coincide with select indicia means on the temporary substitute hanger. The picture is then removed from the substitute hanger and the substitute hanger is rematched with the mark on the wall. Behind the hanger hook is the place for the permanent hanging device to be affixed to the wall. Any number of permanent hanging devices can be utilized. More than one temporary substitute hanger may be needed or utilized for larger items to be hung on a wall. The invention, as described above, quickly and easily allows someone to locate and place a picture hanging device on a wall so that the picture hangs in the desired position. The picture-hanger could be a nail, "J" hook, or gummed label with hook or any of a variety of similar picture hangers.

While the above description contains much specificity, this specificity should not be construed as limitations on the scope of the invention, but rather as an exemplification of the invention. For example, as is described hereinabove, it is contemplated that the present invention essentially discloses an article-hanging device, which may be offered in kit form. The article-hanging device or kit is designed to enable a user to mark at least one select vertical location and hang an article at the select vertical location. The article essentially comprises article-hanging means (such as picture-hanging cord 11) and an article load, (such as picture load 13). The article-hanging kit preferably comprises at least one article-hanging device, each article-hanging device comprising a substantially planar hanger portion and a handle portion, the hanger and handle portions being joined at a handle-hanger junction. The handle portion essentially comprises hand grasp means (such as handle portion 14) and a contact surface (such as the posterior surface of posterior portion 18). The hanger portion comprises an anterior surface, a posterior surface, a hanger terminal region, a hanger junction region, an elongate hanger slot, and a hanger hook. The hanger slot extends from the anterior surface to the posterior surface intermediate the hanger terminal region and the hanger junction region. The hanger hook extends from the anterior surface toward the hanger junction region adjacent the hanger terminal region at a hook junction. The hanger hook is designed for receiving the article-hanging cord and the hook junction is sufficiently formed to support the article load. The hanger junction region is attached to the handle portion at the handle-hanger junction. The posterior surface is substantially coplanar with the contact surface (for allowing ease of movement or to prevent snagged movement at a planar attachment wall 53). The hanger junction and the hanger slot are cooperative for enabling the user to mark the select vertical location. Each article-hanging device thus enables the user to mark the select vertical location and hang the article at the select vertical location.

As has been indicated, the kit may comprise at least two article-hanging devices, the two article-hanging devices for enabling a user to mark a laterally-spaced, uniform vertical location and hang the article or picture at the uniform vertical location, the article or picture being supportable by the laterally spaced article-hanging devices. The kit may further comprise at least one, possibly two, article or picture anchor(s) for fixed, laterally-spaced, article-supporting or picture-supporting placement. A superior article or picture portion thus becomes substantially leveled when the article-hanging cord is supported by the fixed, laterally-spaced article anchors. Further contemplates is a kit comprising mark making means, as exemplified my marking pencils 35 as generally referenced in FIG. Nos. 3 and 4.

Accordingly, although the invention has been described by reference to a preferred embodiment, it is not intended that the novel device, method, or kit be limited thereby, but that modifications thereof are intended to be included as falling within the broad scope and spirit of the foregoing disclosure, the following claims and the appended drawings.

We claim:

1. A picture-hanging device, the picture-hanging device for enabling a user to mark a select vertical location and hang a picture at the select vertical location, the picture comprising a picture-hanging cord and a picture load, the picture-hanging device being formed from a single piece of loopable, substantially planar, elongate material and comprising a looped handle portion, a substantially planar hanger portion, and a handle-hanger junction, the handle portion comprising a substantially planar anterior portion, a substantially planar posterior portion, and a semi-cylindrical handle terminal region, the handle terminal region joining the anterior portion to the posterior portion opposite the handle-hanger junction, the anterior portion comprising a substantially planar junction region, the junction region angularly attaching the anterior portion to the posterior portion at the handle-hanger junction, the hanger portion comprising an anterior surface, a posterior surface, a hanger terminal region, a hanger junction region, an elongate hanger slot, and a hanger hook, the hanger slot having a hook end and an open end and extending from the anterior surface to the posterior surface, the hook end being adjacent the hanger terminal region, the open end being adjacent the hanger junction region, the hanger hook extending from the anterior surface toward the hanger junction region intermediate the hanger terminal region and the hook end at a hook junction, the hanger hook being sized and shaped to receive the picture-hanging cord, the hook junction being sufficiently formed to support the picture load, the anterior portion being substantially parallel to the posterior portion, the looped handle portion thus having a substantially uniform loop thickness, the hanger portion being coplanar with the posterior portion, the hanger junction region comprising indicia means upon the anterior surface, the indicia means and the hanger slot enabling the user to mark the select vertical location, the picture-hanging device thus enabling the user to mark the select vertical location and hang the picture at the select vertical location.

2. The picture-hanging device of claim 1 wherein the anterior portion has an anterior length and the posterior portion has a posterior length, the difference between the posterior length and the anterior length being substantially equal to the diameter of the semi-cylindrical handle terminal region.

3. The picture-hanging device of claim 2 wherein the anterior length measures about 4 inches, the junction region measures about 1 inch, the hanger length measures about 7 inches, the hanger slot has a slot length, the slot length measuring about 2 inches, and the hanger and handle widths measure about 1 inch.

4. The picture-hanging device of claim 3 wherein the substantially planar, elongate material has a substantially uniform material thickness, the material thickness measuring about 0.0625 inches.

5. The picture-hanging device of claim 4 wherein the hanger terminal region and the handle terminal region are each rounded for preventing snagged movement thereof.

6. The picture-hanging device of claim 1 wherein the indicia means are defined by a plurality of parallel linear markings, the linear markings extending across the hanger junction region perpendicular to a longitudinal axis of the hanger portion, the linear markings and the hanger slot enabling the user to mark the select vertical location.

7. The picture-hanging device of claim 6 wherein the plurality of linear markings are substantially equally-spaced and sequentially-numbered, the equally-spaced and sequentially-numbered linear markings enabling the user to effectively mark the select vertical location.

8. A picture-hanging device, the picture-hanging device for enabling a user to mark a select vertical location and hang a picture at the select vertical location, the picture comprising a picture-hanging cord and a picture load, the picture-hanging device being formed from a single piece of loopable, substantially planar, elongate material and comprising a handle portion, a hanger portion, and a handle-hanger junction, the handle portion comprising a substantially planar anterior portion, a posterior portion, and a semi-cylindrical handle terminal region, the handle terminal region joining the anterior portion to the posterior portion opposite the handle-hanger junction, the anterior portion comprising a substantially planar junction region, the junction region angularly attaching the anterior portion to the posterior portion at the handle-hanger junction, the anterior portion being substantially parallel to the posterior portion, the handle portion thus having a substantially uniform loop thickness, the hanger portion comprising an anterior surface, a posterior surface, a hanger terminal region, a hanger junction region, an elongate hanger slot, and a hanger hook, the hanger slot having a hook end and an open end and extending from the anterior surface to the posterior surface, the hook end being adjacent the hanger terminal region, the open end being adjacent the hanger junction region, the hanger hook extending from the anterior surface toward the hanger junction region intermediate the hanger terminal region and the hook end at a hook junction, the hanger hook being sized and shaped to receive the picture-hanging cord, the hook junction being sufficiently formed to support the picture load, the hanger junction region being attached to the handle portion at the handle-hanger junction, the hanger portion being coplanar with the posterior portion, the hanger junction region comprising indicia means upon the anterior surface, the indicia means and the hanger slot enabling the user to mark the select vertical location, the picture-hanging device thus enabling the user to mark the select vertical location and hang the picture at the select vertical location.

9. The picture-hanging device of claim 8 wherein the anterior portion has an anterior length and the posterior portion has a posterior length, the difference between the posterior length and the anterior length being substantially equal to the diameter of the semi-cylindrical handle terminal region.

10. The picture-hanging device of claim 9 wherein the anterior length measures about 4 inches, the junction region measures about 1 inch, the hanger length measures about 7 inches, the hanger slot has a slot length, the slot length measuring about 2 inches, and the hanger and handle widths measure about 1 inch.

11. The picture-hanging device of claim 10 wherein the substantially planar, elongate material has a substantially uniform material thickness, the material thickness measuring about 0.0625 inches.

12. The picture-hanging device of claim 11 wherein the hanger terminal region and the handle terminal region are each rounded for preventing snagged movement thereof.

13. The picture-hanging device of claim 8 wherein the indicia means are defined by a plurality of parallel linear markings, the linear markings extending across the hanger junction region perpendicular to a longitudinal axis of the hanger portion, the linear markings and the hanger slot enabling the user to mark the select vertical location.

14. The picture-hanging device of claim 13 wherein the plurality of linear markings are substantially equally-spaced and sequentially-numbered, the equally-spaced and sequentially-numbered linear markings enabling the user to effectively mark the select vertical location.

15. A picture-hanging device, the picture-hanging device being formed from a single piece of loopable, substantially planar, elongate material and comprising a looped handle portion, a hanger portion, and a handle-hanger junction, the handle portion comprising a substantially planar anterior portion, a posterior portion, and a semi-cylindrical handle terminal region, the anterior portion and the posterior portion being joined at the handle-hanger junction, the hanger portion comprising an anterior surface, a posterior surface, a hanger terminal region, a substantially planar hanger junction region, an elongate hanger slot, and a hanger hook, the hanger slot having a hook end and an open end and extending from the anterior surface to the posterior surface, the hook end being adjacent the hanger terminal region, the open end being adjacent the hanger junction region, the hanger hook extending from the anterior surface toward the hanger junction region intermediate the hanger terminal region and the hook end at a hook junction, the hanger hook being sized and shaped to receive a picture-hanging cord, the hook junction being sufficiently formed to support a picture load, the hanger junction region being angularly attached to the handle portion at the handle-hanger junction, the anterior portion being substantially parallel to the posterior portion, the handle portion thus having a substantially uniform loop thickness, the hanger junction region comprising indicia means upon the anterior surface, the indicia means and the hanger slot enabling the user to mark a select vertical location.

16. The picture-hanging device of claim 15 wherein the anterior portion has an anterior length and the posterior portion has a posterior length, the difference between the posterior length and the anterior length being substantially equal to the diameter of the semi-cylindrical handle terminal region.

17. The picture-hanging device of claim 15 wherein the indicia means are defined by a plurality of parallel linear markings, the linear markings extending across the hanger junction region perpendicular to a longitudinal axis of the hanger portion, the linear markings and the hanger slot enabling the user to mark the select vertical location.

* * * * *